US007735874B2

(12) United States Patent
Bridges

(10) Patent No.: US 7,735,874 B2
(45) Date of Patent: Jun. 15, 2010

(54) PROTECTIVE LABEL

(76) Inventor: Lori Ann Bridges, P.O. Box 21536, Eugene, OR (US) 97402

( * ) Notice: Subject to any disclaimer, the term of this patent is extended or adjusted under 35 U.S.C. 154(b) by 0 days.

(21) Appl. No.: 12/002,580

(22) Filed: Dec. 18, 2007

(65) Prior Publication Data

US 2009/0152860 A1 Jun. 18, 2009

(51) Int. Cl.
*B42D 15/00* (2006.01)

(52) U.S. Cl. ..... 283/101; 40/661

(58) Field of Classification Search ..... 283/80, 283/81, 101, 106, 107–110; 428/40.1, 203, 428/204, 205; 40/638, 661, 634; 156/249, 156/277, 278, 289
See application file for complete search history.

(56) References Cited

U.S. PATENT DOCUMENTS 2,979,840 A * 4/1961 Eastman ..... 40/638
4,101,701 A * 7/1978 Gordon ..... 428/189
4,180,929 A * 1/1980 Schultz, Jr. ..... 283/108
4,645,241 A * 2/1987 Sfikas ..... 283/109
4,742,954 A * 5/1988 Shishido ..... 229/92.8
4,907,359 A * 3/1990 Berman ..... 40/675
4,914,843 A * 4/1990 DeWoskin ..... 40/633
5,284,363 A * 2/1994 Gartner et al. ..... 283/81
5,411,784 A * 5/1995 Brewster ..... 428/131
5,773,111 A * 6/1998 Brewster ..... 428/40.1
6,117,264 A * 9/2000 Brewster ..... 156/249
6,224,110 B1 * 5/2001 Ambridge et al. ..... 283/81
6,490,821 B1 * 12/2002 Lacek ..... 40/673
7,479,199 B2 * 1/2009 Ray et al. ..... 156/204
2008/0028646 A1 * 2/2008 Sullivan et al. ..... 40/124.91

* cited by examiner

*Primary Examiner*—Dana Ross
*Assistant Examiner*—Matthew G Katcoff
(74) *Attorney, Agent, or Firm*—David S. Alavi

(57) ABSTRACT

A protective label including: a printable base panel; a transparent securing flap; a protective flap; wherein the base panel is affixed to and substantially sealed with the transparent securing flap; and wherein the protective flap maintains the legibility of the printed material on the base panel.

27 Claims, 4 Drawing Sheets

Improved Protective Label

PROTECTIVE LABEL

CROSS REFERENCE TO RELATED APPLICATION

None

BACKGROUND OF THE INVENTION

The present invention relates generally to tags or labels or functionally similar devices (hereinafter collectively "label" or "labels"). The present invention relates specifically to labels for use in industrial applications, including the identification of: machinery; process control system components; conveyance system components (whether material conveyed is a solid, liquid or gas or combination thereof); electrical system components; hazards; dangers; and the like. Labels are often color coded and/or contain alphanumeric content to readily provide information to an observer. The observer could be a worker, inspector or any other person who may need to see or read the label. Labels often include a protective window, so the information itself is not exposed to degrading elements or contact and thereby subjected to damage.

The present invention is particularly useful for applications wherein the label, including a protective window, may be degraded by its environment or use (including misuse). "Degraded" may include anything that may negatively impact the legibility of the label by covering or damaging the information, label, or the label's protective window, including damage that limits the translucency or transparency of the protective window. The present invention is useful and is particularly adapted for harsh industrial environments including pulp and paper mills, chemical plants, other types of mills and refineries. Splattered liquids, chemical damage, air-born debris such as lime dust in a woods product mill and electromagnetic radiation (such as light) all may degrade a label and are common to many industrial environments. The usefulness of the present invention is not, however, limited to industrial environments. A label that is legible, even though it has been degraded, would be useful regardless of where or how it may be degraded.

The prior art is replete with examples of means to protect written material by covering the written material with a transparent protective synthetic material or coating. The prior art also includes U.S. Pat. No. 6,490,821 "Printable tag with integral fastener" which includes a flap overlying a window with a printable substrate, however, the purpose of the flap is to define a slit which enables the tag to be secured to an article—the flap does not protect the window. The prior art also includes U.S. Pat. No. 4,914,843 "Identification Band" which includes adhesive means to secure a transparent strip to a backing strip receptive to a pre-printed insert. The transparent strip is not protected. Therefore, if the transparent strip is sufficiently degraded the information will be illegible.

The FLAP TAG™ assembled by the Applicant is also prior art. It is comprised of a printable base panel and a transparent securing flap, but it does not include a protective flap. The prior art FLAP TAG™ may be rendered illegible when used in the industrial environments sited above.

BRIEF SUMMARY OF THE INVENTION

The present invention provides a means for protecting a label. Specifically, the present invention provides a protective label which includes: a printable base panel; a transparent securing flap; and a protective flap. The base panel is affixed to and substantially sealed with the transparent securing flap.

The protective flap maintains the legibility of the printed material on the base panel by protecting the transparent securing flap. In the event the label is degraded, it is the protective flap—not the securing flap—that is degraded. Therefore, when the protective flap is folded away from the securing flap the information on the base panel is still legible. After the protective label is read, the reader may merely release the protective flap, whereupon it will spontaneously unfold and return to a position such that it overlays the transparent securing flap and protects the transparent securing flap and the information on the base panel.

For a more complete understanding of the present invention, its objects and advantages refer to the following Description of the Preferred Embodiments, Drawings and Claims.

DETAILED DESCRIPTION OF THE INVENTION

Figure 1:
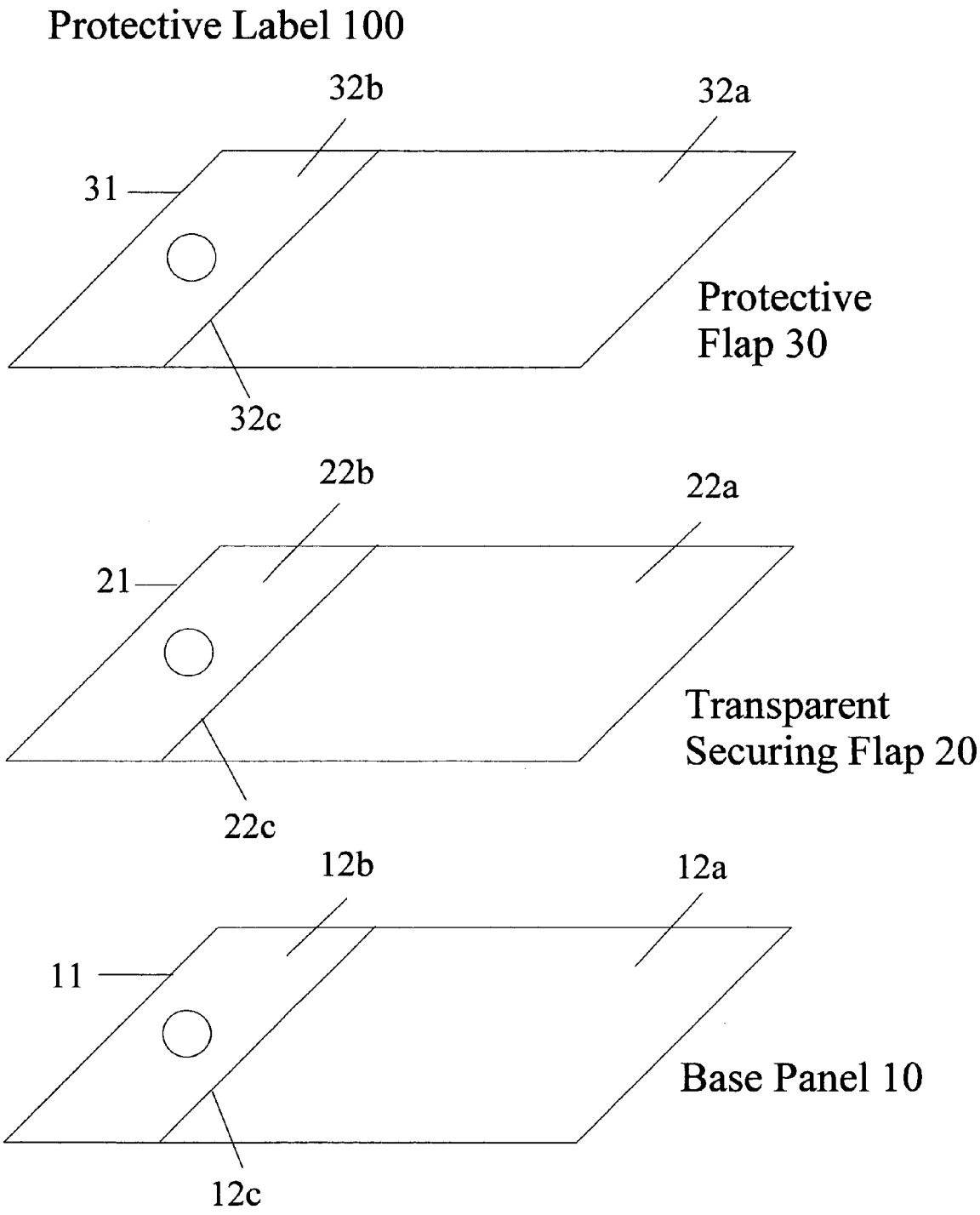
FIG. 1 is an exploded view of a preferred embodiment of protective label useful in understanding how the label is layered and used.

Referring to FIG. 1, protective label 100 (the present invention) includes a base panel 10. An upper planar surface 12 of base panel 10 includes display surface section 12*a*, fixed-end surface section 12*b* and axis 12*c*. Display surface 12*a* provides a surface for a user to provide and display the information, which may, or may not, be alphanumeric. The information may be inscribed (hand written) with, for example a pen or Sharpie permanent marker, an ink marker, or on a sticky-back tag (not shown) which may then be affixed to display surface 12*a*. Alternative means for providing and displaying information includes a liquid crystal display (not shown), plasma display panel (not shown) or the like which can be integral to the base panel 10. The information to be displayed is the user's prerogative. Laws often require specific information to be displayed (e.g. on a label) in certain industrial applications (see above). For the purposes of this patent (application), the "user" provides the information and places, locates or hangs the label where it is required, whereas the "observer" desires to read the information displayed on the label.

Base panel 10 also includes a lower planar surface that is not shown and a leading edge 11. The leading edge 11 may be narrow. A light-weight, thin, and elastic (when handled by humans) protective label 100 is preferred even though base panel 10 preferably has a noticeably higher modulus of elasticity than the label's flaps (see below). A relatively rigid base panel 10 made of a porous plastic will facilitate the application of ink (that is, information) thereto—by hand or other means. Base panel 10 may house other display means. In the most preferred embodiment the, base panel is made from $1/16^{th}$ of an inch thick 0600 UVI plastic which is made by Primex Plastics or fiberglass linerboard made by Lasco which goes by the product name LASCOBOARD. Other relatively rigid materials that preferably come in white and allow for color to be added with UV inhibited inks are preferable including those made by Nazdar. Varying the ink color, and thereby the color of base panel 10, allows the user to vary the color of protective label 100. Planar surface 12 and the lower planar surface may be colored, the same color or different colors, based upon the user's needs. Color added to base panel 10 may be informative or may render protective label 100 conspicuous. Preferably panel 10 has a modulus of elasticity such that it deforms from moderate bending and torsion forces from rough human handling.

Alternatively base panel 10 may be made from aluminum, other plastics or other materials depending upon: the user's needs; the content of the information on protective label 100; the environment in which protective label 100 will be used; and the means by which the information will be displayed.

Figure 2:
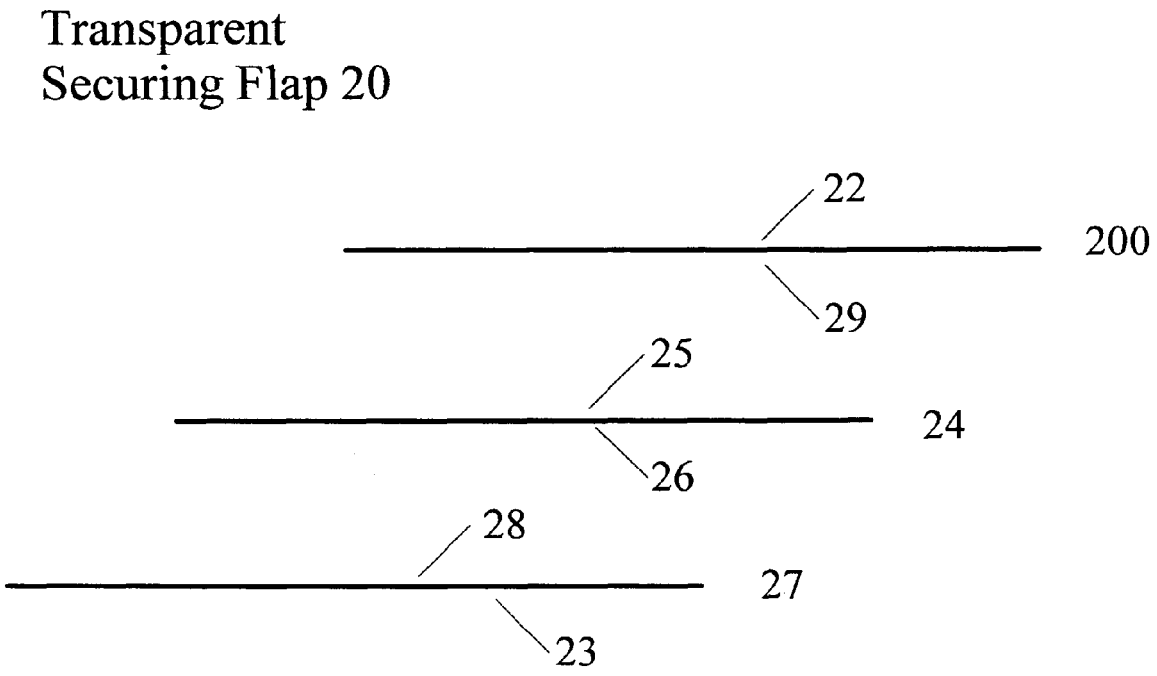
FIG. 2 is an exploded side view of a preferred embodiment of the protective label's transparent securing flap

Protective label 100 also includes a transparent securing flap 20 which includes: an upper planar surface comprising a window section 22*a*, a fixed-end surface section 22*b*, and axis 22*c*; a lower planar surface; and a leading edge 21. Referring now to FIG. 2, an exploded side view of transparent securing flap 20 is depicted. Transparent securing flap 20 includes a film 200, an adhesive 24 and a substantially contiguous removable liner 27. Preferably film 200, adhesive 24 and substantially contiguous removable liner 27 have substantially similar dimensions and are substantially similarly oriented, so they may be superimposed, directly and indirectly, with each other. Film 200 has an upper planar surface 22 and a lower planar surface 29. Adhesive 24 has an upper planar surface 25 and a lower planar surface 26. Substantially contiguous removable liner 27 has an upper planar surface 28 and a lower planar surface 23.

Adhesive 24 upper planar surface 25 is substantially contiguous with film 200 lower surface 29 wherein adhesive 24 is (originally) protected with a substantially contiguous removable liner 27. Adhesive 24 lower planar surface 26 is substantially contiguous with upper planar surface 28 of release liner 27.

Many plastic flaps, or covers, with adhesive backs are available. The transparent securing flap 20 may come from the manufacturer with film 200, adhesive 24 and release liner 27 included, that is, transparent securing flap 20 comes from the manufacturer with adhesive 24 surface 25 affixed to film 200 surface 29 and release liner 27 surface 28 releasably affixed to adhesive surface 26. Release liner 27 (originally) protects the adhesive 24 on lower surface 29 until preferably the user desires to affix, in whole or in part (see below), transparent securing flap 20 to base panel 10. For example, release liner 27 may be easily removed, in its entirety (not preferably) after information has been provided (or means therefore have been provided) to base panel 10, and wherein film 200 is substantially contiguously affixed, in whole, to base panel 10 upper surface 12 with adhesive 24 by the user thereby protecting, and substantially sealing, the information on base panel 10. Preferably transparent securing flap 20 is comprised of a 2 mils polyester film by the name "Ultra Tack Printable Clear Polyester" which is a clear (with high optical clarity) print treated polyester film (film 200), which is coated with a high tack permanent acrylic pressure sensitive adhesive (adhesive 24), and a 90# stay flat liner (release liner 27). Adhesive 24 is approximately 0.8 to 1.1 mils thick. Release liner 27, which protects the adhesive until it is ready to be used, is approximately 6.7 mils. Such polyester sheeting with adhesive and liner is made by General Formulations.

Protective label 100 also includes a protective flap 30 with a leading edge 31 and an upper planar surface 32 and a lower planar surface (not shown). Preferably protective flap 30 is transparent, but flap 30 does not have to be transparent. Transparency is preferred because the information on base panel 10 will be legible when protective flap 30 is not degraded. Preferably protective flap 30 has one or more of the following characteristics: durability; temperature resistance; and chemical resistance. Preferably protective flap 30 is made from General Electric's "Valox" film which has no adhesive and is heat stabilized, chemically resistant and has a low shrinkage with high optical clarity.

Preferably protective flap 30, transparent securing flap 20 and base panel 10 have substantially similar dimensions and are substantially similarly oriented so as when combined render an ergonomic and functional protective label 100.

Figure 3:
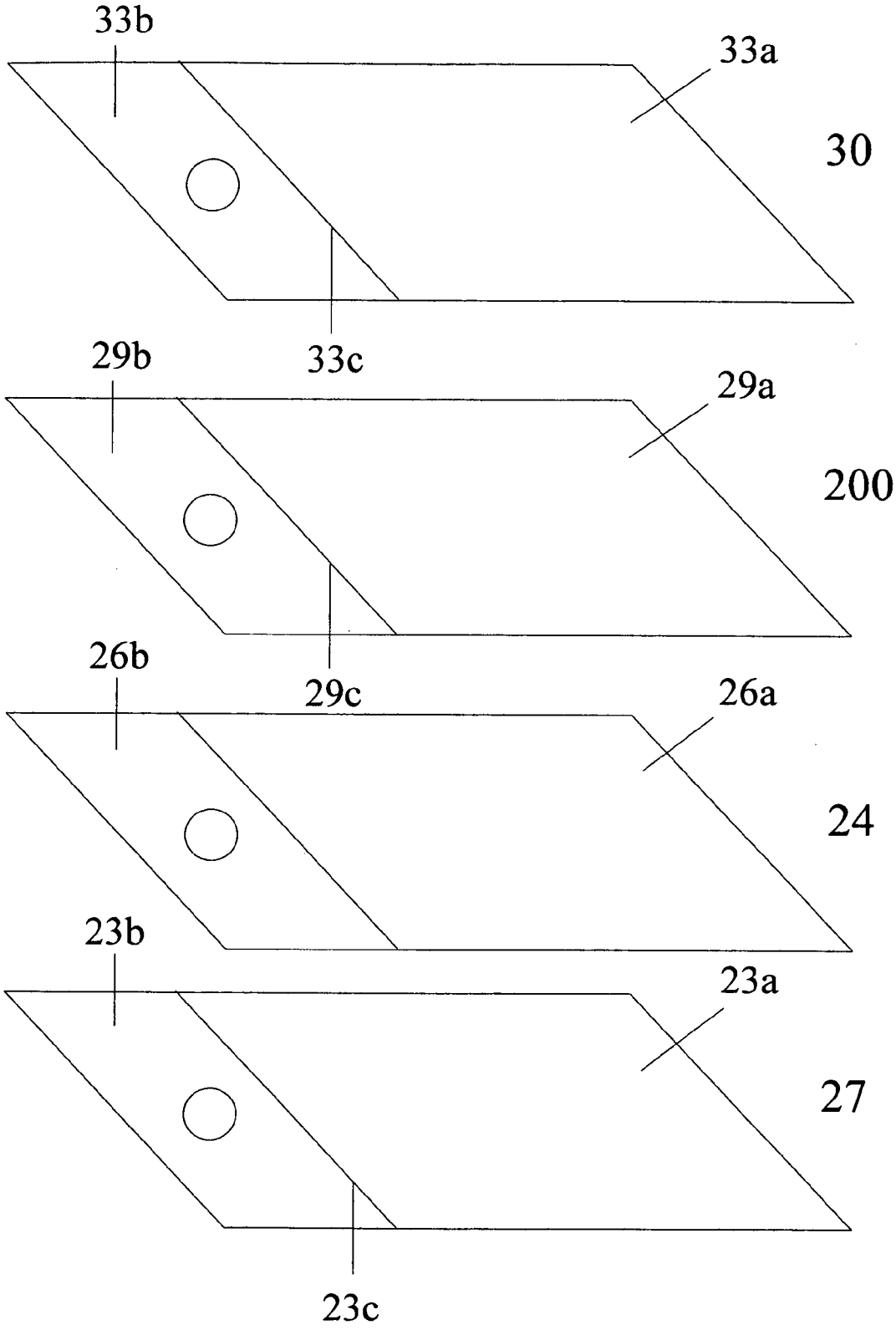
FIG. 3 is an exploded view of the lower surfaces of transparent securing flap, including a film, an adhesive material, and a removable protective liner, and the protective flap.

Referring now to FIG. 3, an exploded perspective view of transparent securing flap 20 is depicted including lower planar surface 29 of film 200, lower planar surface 26 of adhesive 24 (a substantially contiguous adhesive with substantially similar length and width—not necessarily depth—dimensions as film 200 lower surface 29) and lower planar surface 23 of release liner 27 (with substantially similar length and width—not necessarily depth—dimensions as film 200 lower surface 29).

The preferred method for making protective label 100 will now be described. Base panel 10, transparent securing flap 20 and protective flap 30 are individually procured. Means for partially affixing transparent securing flap 20 to base panel 10 include: scoring release liner 27 along longitudinal axis 23*c*; removing section 23*b* of release liner 27, thereby exposing adhesive section 26*b*; wherein adhesive section 26*b* may be easily overlaid on to, and substantially contiguously affixed to, section 12*b* of base panel 10, wherein 12*b*, 29*b* and 22*b* become substantially fixed-end sections of protective label 100. Preferably base panel 10 is sufficiently rigid relative to flap 20 (and flap 30), thereby providing an axis of rotation for transparent securing flap 20 substantially along longitudinal axes 22*c*/29*c* which are now substantially co-linear, and both are substantially co-linear with longitudinal axis 12*c*. The low modulus of elasticity of transparent securing flap 20 allows its free end window 22*a* to be easily folded away from planar base panel 10 display surface 12*a*, with an axis of rotation substantially collinear with longitudinal axes 12*c*/22*c*/29*c*, away from base panel 10 display surface 12*a*, allowing the user to easily access and inscribe or apply information (or means for displaying information) on to base panel 10 display surface 12*a*.

The preferred method of making (or manufacture) includes means for affixing a portion of protective flap 30 to transparent securing flap 20 (this may be done before or after transparent securing flap 20 fixed-end 22*b*/29*b* is affixed to base panel 10 fixed-end 12*b*). A two-sided adhesive (not shown) may be applied to (affixed to) protective flap 30 fixed-end section 33*b* so that it may be substantially contiguously affixed to section 22*b* of transparent securing flap 20, thus 33*b* also becomes part of the fixed-end sections of protective label 100. The two-sided adhesive alternatively may be first applied to section 22*b* and then affixed to 33*b*. Alternatively section 22*b* or 33*b* may come from its manufacturer with an adhesive (not shown) and a corresponding substantially contiguous release liner (not shown) which may then serve, in either case, as a means for timely affixing 22*b* to 33*b*. Regardless of the means for affixing 22*b* to 33*b* an axis of rotation for protective flap 30 is thereby established substantially along protective flap 30 longitudinal axes 32*c*/33*c* which are now overlaid on and substantially co-linear with longitudinal axis 22*c* (it also does not matter if 22*b* is affixed to 33*b* before or after 29*b* is affixed to 12*b*). When at rest the three components 10, 20 and 30 of manufactured protective label 100, with a common fixed-end, lay flat as the physical properties of flap 20 cause its free-end window 22*a* to lay flat on base panel 10 display surface 12*a* and the physical properties of the protective flap 30 cause the free-end lower surface 33*a* to lay flat on flap 20 free-end 22*a*.

The preferred method of use will now be described. Preferably, protective label 100 is provided to the user after it has been manufactured/constructed—with principal components 10, 20 and 30 having a common fixed-end and wherein the principal label components lay flat. It should be appreciated, however, that it is not mandatory that complete manufacture is a condition precedent for preliminary use. Information may be provided to base panel 10 display surface 12*a* before or after flap 20 is affixed to panel 10 or before or after flap 30 is affixed to flap 20.

The low modulus of elasticity of flap 20 allows base panel 10 to be easily held by the user who simultaneously may easily fold away flap 20 free-end 22*a* from base panel 10 display 12*a* (and when flap 30 free-end 32*a* is easily folded away from flap 20 free-end 22*a*). A side view of the folded away transparent securing flap 20 may substantially resemble the exponential function curve $2^x$. When released, the elastic transparent securing flap 20 will spontaneously rotate or fold back (elastically), or unfold back onto and overlay, planar base panel 10 display surface 12*a*. There is no damage to the transparency or translucency of flaps 20 or 30 when they are bent or twisted during typical use. The user of protective label 100 merely needs to fold transparent securing flap 20 away from base panel 10 to inscribe, or apply, on display surface 12*a* whatever information may be required by law or is otherwise necessary or desired by the user or the observer. Then release liner 27 free-end 27*a* (not shown but including lower planar surface 23*a*) and may be peeled away from adhesive 24 section 26*a* of transparent securing flap 20 exposing adhesive 26*a* which may then be affixed to display surface 12*a*. The optical properties of adhesive 24 and film 200 allow the information on display surface 12*a* to be clearly read. Adhesive 24 seals the information preventing any degrading elements from infiltrating the information's environment and potentially compromising the legibility of the information.

Protective flap 30 preferably has a substantially similar modulus of elasticity as transparent securing flap 20. Therefore, when the free-end of transparent securing flap 20 is folded away from display surface 12*a* (prior to sealing the information) the free-end of protective flap 30 is elastically deformed in a similar manner. The axis of rotation is substantially co-linear with longitudinal axes 33*c*/32*c*/22*c*, so that protective flap 30 window 32*a* may be folded away with transparent securing flap 20 window 22*a*. With such physical properties free-end 32*a*, subsequent to sealing the information, may be folded away from fixed window 22*a*, allowing the observer to easily remove a degraded protective flap 30 free-end window 32*a* in order to read the information displayed on base panel 10. Once securing flap 20 is affixed (or secured) to base panel 10 protective flap 30 protects transparent securing flap 20 window 22*a* until folded way from window 22*a*. Protective window 32*a* will spontaneously rotate or fold back (elastically), or unfold back onto and overlay, planar transparent securing flap 20 window surface 22*a*, and thereby protect surface 22*a* and the legibility of the information.

When the protective flap 30 is transparent and is not degraded then the information will be legible without manipulating (folding away) window 32*a* (twisting and/or bending that moves 32*a* away from 22*a*). If protective flap 30 is degraded (specifically window 32*a* of protective flap 30), regardless of whether or not flap 30 is transparent, flap 30 can be readily folded or bent or twisted away from the protected window 22*a* (preferably in the same manner transparent securing flap was folded as described above) to uncover the legible information. A side view of the preferable folding away of protective window 32*a* may also substantially resemble the exponential function curve $2^x$. As was the case with the folded away (bent or twisted or both) transparent securing flap 20, protective flap 30, when released, will spontaneously unfold (rotate) back (elastically) wherein it will again overlay and protect window 22*a*.

Figure 4:
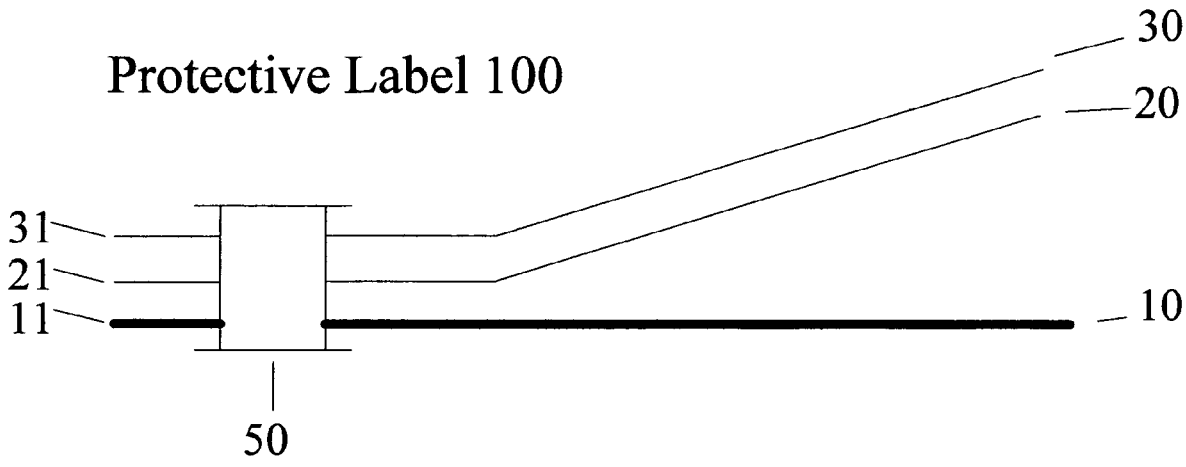
FIG. 4 is a side view of a protective label with a grommet binding one end of protective label components: base panel, transparent securing flap and protective flap.

Preferably, as depicted in FIG. 4 a grommet 50 may be added so protective label 100 may be conveniently hung. The grommet alternatively may be the means for affixing fixed ends of flaps 20 and 30 to base panel 10 before or after information is provided to base panel 10.

Alternatively, leading edges 11, 21 and 31 may be affixed to each other with an adhesive or functional equivalent wherein protective label 100 flaps 20 and 30 are affixed to base panel 10 in a manner similar to how a book is bound together by a strong flexible glue at the spine of the book (edges of the book's pages); in the subject invention the "pages" are in effect flaps 20 and 30 and panel 10 and leading edges 11, 21 and 31 of base panel 10 and flaps 20 and 30 respectively are glued together.

Other means for binding or affixing, including glues, cements, bioadhesives, elastomers, thermoplastics and thermosetting adhesives are well known in the art. Other means for affixing protective flap 30, transparent securing flap 20 and base panel 10, in whole are in part, to establish a common fixed-end are well known in the art without departing from the scope of the present invention.

It should be appreciated that while the preferred embodiment of the present invention includes transparent securing flap 20 and adhesive 24 wherein flap 20 comes from a manufacturer with adhesive 24 which covers the entire lower planar surface 29 of film 200, this is not mandatory—it is only preferable. Any means for isolating the information on base panel 10 from any degrading elements in protective label 100's environment of use is adequate. For example, if adhesive 24 were only along the periphery of film 200 window 29*a*, the information may be adequately isolated and protected from the degrading elements after flap 20 free-end lower planar surface 29*a* is affixed to panel 10 window 12*a*.

As depicted in FIG. 1 preferably the base panel 10, transparent securing flap 20 and protective flap 30 are rectangular with substantially the same lengths and widths. Alternatively these three principal components of protective label 100 could have a range of different sizes and shapes without departing from the scope of the present invention—the lengths and widths of the three principle components do not have to be substantially similar and may have different shapes.

As also depicted in FIG. 1 and described herein the three principal components of protective label 100 share a fixed-end at one of the short sides of the rectangular principal components. It should be appreciated that not only may the fixed-end vary (the fixed-end of the flap 20 and flap 30 may be different than the fixed-end of base 10 and flap 20) but where it is (short-side versus (width) the long-side (length) of the rectangular principal components as depicted in FIG. 1) may vary as well without departing from the scope of the present invention.

It should also be appreciated that while the present invention includes a base panel 10 which has the ability to display information that does not mean the present invention may not include means for combining the functions of the base panel 10 and transparent securing flap 20. Liquid crystals could be the base panel or be embedded in transparent securing flap 20 wherein base panel 10 provides rigidity for ease of use and a protective housing if necessary. The protective flap 30 in such an embodiment would still provide for an improved protective label.

In the preferred method of use the user adds information to base panel upper surface 12 with a felt marker or adhesive label and then applies the transparent securing flap 20 thereto after removing release liner 27. Transparent securing flap 20 protects the information. Protective flap 30 protects transparent securing flap 20. The information is still legible if protective flap 30 is substantially transparent and not degraded. If protective flap 30 is opaque or degraded then it may be easily folded away from, and thereby exposing, the non-degraded transparent securing flap 20 and the information thereunder on base panel 10. This is the principal function of the present invention regardless of how protective label 100 is manufactured or constructed or its principal components 10, 20 and 30 are shaped or oriented.

In the preferred embodiment of the subject invention protective flap 30, and specifically window 32*a*, has the physical properties to protect transparent securing flap 20 from degradation when flap 30 fixed-end 32*b* is fixed to securing flap fixed-end 22*b* and window 32*a* is at rest on securing flap 20 window 22*a*. Alternatively, securing flap 20 window 22*a* may protect window 12*a* of base panel 10 when window 22*a* is at rest on window 12*a* when fixed-end 22*b* is affixed to base panel 10 fixed-end 12*b*. Therefore, with departing from the subject invention it is not necessary for transparent securing flap 20 window 22*a* to be affixed to, in whole or in part, to base panel window 10 window 12*a*. The physical properties of securing flap 20 may be changed (for example flap 20's modulus of elasticity) so that window 22*a* is more predisposed to lay on, and more difficult to fold away from, 12*a*.

Alternatively, the physical properties of protective flap 30 may also be changed (for example flap 30's modulus of elasticity) so that window 32*a* is more predisposed to lay on, and more difficult to fold away from, 22*a*.

Alternatively, base panel 10, transparent securing flap 20 and protective flap 30 need not have the same physical properties through their cross-sections. For example, it may be advantageous for the fixed-end of flaps 20 and 30 to have different properties than their free-ends.

Alternatively, flaps 20 and 30 need not have the same physical properties, including modulus of elasticity. For example, if information is added to base panel 10 window 12*a* prior to any portion of flap 20 being affixed to any portion of base panel 10, then it would only be preferred that flap 20 have a similar modulus of elasticity as base panel 10—not as protective flap 30—as long as flap 20 may be practically affixed to base panel 10.

Alternatively, transparent securing flap 20 may be integral to base panel 10, that is, base panel 10 may house the information and have means for protecting the information with an alternative to transparent securing flap 20.

Alternatively, transparent securing flap 20 may have a means for displaying information within the flap 20 wherein base panel 10 may only provide structural means for securing the means for displaying information.

Alternatively, transparent securing flap 20 may have means for displaying information within the flap 20 wherein a first protective flap (not shown) may be on one side of flap 20 and a second protective flap 30 (not shown) may be on the other.

I claim:

1. An article comprising:

a base panel having at least a portion of its upper surface adapted for retaining thereon indicia of displayed information;

a securing flap secured to the base panel and having an upper surface and a lower surface; and a flexible protective flap having a lower surface and comprising (i) a fixed-end section that is secured to the base panel and the securing flap and (ii) a free-end section that includes at least a portion of an edge of the protective flap, wherein:

the base panel and the securing flap are arranged so that at least a portion of the securing flap can overlie indicia retained on the upper surface of the base panel so that the retained indicia are observable through the securing flap;

the base panel, the securing flap, and the protective flap are arranged so that at least part of the free-end section of the protective flap can overlie the retained indicia with at least a portion of the securing flap between the lower surface of the free-end section of the protective flap and the upper surface of the base panel; and the base panel, the securing flap, and the protective flap are arranged so that the free-end section of the protective flap remains freely, repeatedly movable, without disturbing any of the retained indicia, without any attachment or adhesion to the securing flap, and without any detachment of the fixed-end section of the protective flap, between (i) a first configuration wherein the free-end section of the protective flap overlies the retained indicia and the overlying portion of the securing flap, and (ii) a second configuration wherein the lower surface of the free-end section of the protective flap and the upper surface of the overlying portion of the securing flap are sufficiently separated to yield a line of sight to-the-retained indicia that substantially avoids the protective flap.

2. The article of claim 1 wherein the retained indicia are observable through the protective flap.

3. The article of claim 1 wherein the protective flap comprises an elastically deformable material and is arranged so as to rest with its lower surface against the upper surface of the securing flap in the absence of an externally applied force.

4. The article of claim 1 wherein the securing flap includes an adhesive layer on at least a portion of its lower surface arranged to secure the lower surface of the securing flap to the upper surface of the base panel.

5. The article of claim 4 wherein the securing flap includes a release liner on the adhesive layer.

6. The article of claim 1 wherein the base panel, the securing flap, and the protective flap are secured together near a common edge of each.

7. The article of claim 1 further comprising means for securing together the base panel, the securing flap, and the protective flap.

8. The article of claim 1 further comprising means for hanging the article.

9. The article of claim 1 further comprising a grommet for hanging the article, wherein the grommet penetrates and secures together the base panel, the securing flap, and the protective flap.

10. A method comprising:

adapting at least a portion of an upper surface of a base panel for retaining thereon indicia of displayed information;

securing to the base panel a securing flap having an upper surface and a lower surface; and securing to the base panel and the securing flap a flexible protective flap having a lower surface and comprising (i) a fixed-end section that is secured to the base panel and the securing flap and (ii) a free-end section that includes at least a portion of an edge of the protective flap, wherein:

the base panel and the securing flap are arranged so that at least a portion of the securing flap can overlie indicia retained on the upper surface of the base panel so that the retained indicia are observable through the securing flap;

the base panel, the securing flap, and the protective flap are arranged so that at least part of the free-end section of the protective flap can overlie the retained indicia with at least a portion of the securing flap between the lower surface of the free-end section of the protective flap and the upper surface of the base panel; and the base panel, the securing flap, and the protective flap are arranged so that the free-end section of the protective flap remains freely, repeatedly movable, without disturbing any of the retained indicia, without any attachment or adhesion to the securing flap, and without any detachment of the fixed-end section of the protective flap, between (i) a first configuration wherein the free-end section of the protective flap overlies the retained indicia and the overlying portion of the securing flap, and (ii) a second configuration wherein the lower surface of the free-end section of the protective flap and the upper surface of the overlying portion of the securing flap are sufficiently separated to yield a line of sight to the retained indicia that substantially avoids the protective flap.

11. The method of claim 10 wherein the retained indicia are observable through the protective flap.

12. The method of claim 10 wherein the protective flap comprises an elastically deformable material and is arranged so as to rest with its lower surface against the upper surface of the securing flap in the absence of an externally applied force.

13. The method of claim 10 wherein the securing flap includes an adhesive layer on at least a portion of its lower surface arranged to secure the lower surface of the securing flap to the upper surface of the base panel.

14. The method of claim 13 wherein the securing flap includes a release liner on the adhesive layer.

15. The method of claim 10 wherein the base panel, the securing flap, and the protective flap are secured together near a common edge of each.

16. The method of claim 10 further comprising providing means for hanging the article.

17. The method of claim 10 further comprising providing a grommet for hanging the article, wherein the grommet penetrates and secures together the base panel, the securing flap, and the protective flap.

18. A method comprising:

displaying an article, with a free-end section of a flexible protective flap of the article in a first configuration, in a use environment until exposure to the use environment degrades an exposed upper surface of the protective flap of the article; and moving the free-end section of the protective flap from the first configuration to a second configuration, wherein:

the article comprises (a) a base panel having at least a portion of its upper surface adapted for retaining thereon indicia of displayed information, (b) a securing flap secured to the base panel, and (c) the flexible protective flap having a lower surface and the upper surface and comprising (i) a fixed-end section that is secured to the base panel and the securing flap and (ii) the free-end section that includes at least a-portion of an edge of the protective flap;

the base panel and the securing flap are arranged so that at least a portion of the securing flap overlies indicia retained on the upper surface of the base panel;

the base panel, the securing flap, and the protective flap are arranged so that, in the first configuration, at least part of the free-end section of the protective flap overlies the retained indicia with at least a portion of the securing flap between the lower surface of the free-end section of the protective flap and the upper surface of the base panel; and the base panel, the securing flap, and the protective flap are arranged so that the free-end section of the protective flap remains freely, repeatedly movable, without disturbing any of the retained indicia, without any attachment or adhesion to the securing flap, and without any detachment of the fixed-end section of the protective flap, between (i) the first configuration and (ii) a second configuration wherein the lower surface of the free-end section of the protective flap and the overlying portion of the securing flap are sufficiently separated to yield a line of sight to the retained indicia that substantially avoids the protective flap.

19. The method of claim 18 further comprising, before displaying the article:

applying to the upper surface of the base panel the retained indicia; and securing at least a portion of the securing flap over the retained indicia.

20. The method of claim 18 further comprising, after moving the free-end section of the protective flap from the first configuration to the second configuration, observing the retained indicia.

21. The method of claim 18 further comprising, after moving the free-end section of the protective flap from the first configuration to the second configuration, permitting the free-end section of the protective flap to return to the first configuration.

22. The method of claim 18 wherein the protective flap comprises an elastically deformable material and is arranged so as to rest with its lower surface against the upper surface of the securing flap in the absence of an externally applied force.

23. The method of claim 18 wherein the securing flap includes an adhesive layer on at least a portion of its lower surface arranged to secure the lower surface of the securing flap to the upper surface of the base panel.

24. The method of claim 18 wherein the securing flap includes a release liner on the adhesive layer, the method further comprising removing the release liner before securing the securing flap to the base panel.

25. The method of claim 18 wherein displaying the article comprises hanging the article.

26. The method of claim 25 wherein the article further comprises a grommet for hanging the article, wherein the grommet penetrates and secures together the base panel, the securing flap, and the protective flap.

27. The method of claim 18 wherein the exposed upper surface of the protective flap is degraded by splattered liquid, chemical damage, air-borne debris, or electromagnetic radiation.

* * * * *